US008980020B2

(12) United States Patent
Sikora et al.

(10) Patent No.: US 8,980,020 B2
(45) Date of Patent: Mar. 17, 2015

(54) METHOD AND DEVICE FOR PRODUCING A METAL COMPONENT

(75) Inventors: Sascha Sikora, Lünen (DE); Kai Schmitz, Wermelskirchen (DE); Axel Grüneklee, Duisburg (DE)

(73) Assignee: ThyssenKrupp Steel Europe AG, Duisburg (DE)

( * ) Notice: Subject to any disclaimer, the term of this patent is extended or adjusted under 35 U.S.C. 154(b) by 0 days.

(21) Appl. No.: 13/410,071

(22) Filed: Mar. 1, 2012

(65) Prior Publication Data

US 2012/0186705 A1 Jul. 26, 2012

Related U.S. Application Data

(63) Continuation of application No. PCT/EP2010/061495, filed on Aug. 6, 2010.

(30) Foreign Application Priority Data

Sep. 1, 2009 (DE) ..... 10 2009 043 926

(51) Int. Cl.

| | |
|---|---|
| ***B32B 15/01*** | (2006.01) |
| ***B21D 53/88*** | (2006.01) |
| ***B21D 22/02*** | (2006.01) |
| ***B21D 37/01*** | (2006.01) |

(Continued)

(52) U.S. Cl.

CPC ..... *B21D 53/88* (2013.01); *B21D 22/02* (2013.01); *B21D 37/01* (2013.01); *B21D 37/16* (2013.01); *C21D 1/673* (2013.01); *C21D 1/56* (2013.01); *C21D 9/48* (2013.01); *C21D 2211/005* (2013.01); *C21D 2211/008* (2013.01); *C21D 2211/009* (2013.01); *C21D 2221/00* (2013.01); *C21D 2221/02* (2013.01); *C21D 2221/10* (2013.01)

USPC ..... 148/516; 148/714

(58) Field of Classification Search

CPC ..... B21D 22/02; B21D 37/16

USPC ..... 148/516, 714

See application file for complete search history.

(56) References Cited

U.S. PATENT DOCUMENTS

| | | | |
|---|---|---|---|
| 2002/0113041 | A1 | 8/2002 | Ozawa |
| 2004/0112485 | A1 | 6/2004 | Reinhold et al. |

FOREIGN PATENT DOCUMENTS

| | | | |
|---|---|---|---|
| DE | 890 035 | C | 9/1953 |
| DE | 197 23 655 | A1 | 12/1997 |

(Continued)

*Primary Examiner* — Kaj K Olsen
*Assistant Examiner* — Alexander Polyansky
(74) *Attorney, Agent, or Firm* — Reinhart Boerner Van Deuren P.C.

(57) ABSTRACT

The invention relates to a method for producing a metal structural component, in particular a vehicle structural component, in which a steel part is hot formed and is hardened at least over sections by contact with a tool surface, in which the steel part is during the hardening cooled in at least two partial regions at different cooling rates, so that the partial regions after the hardening differ in their microstructure, wherein the cooling rates differing from one another are produced by sections of the tool surface corresponding to the partial regions of the steel part, which differ from one another as regards their thermal conductivities. The invention also relates to a further method for producing a metal structural component, as well as a tool and a batch furnace.

12 Claims, 6 Drawing Sheets

(51) Int. Cl.

| | |
|---|---|
| ***B21D 37/16*** | (2006.01) |
| ***C21D 1/673*** | (2006.01) |
| *C22F 1/16* | (2006.01) |
| *C21D 1/56* | (2006.01) |
| *C21D 9/48* | (2006.01) |

(56) References Cited

FOREIGN PATENT DOCUMENTS

| | | | | | |
|---|---|---|---|---|---|
| DE | 102 56 621 | B3 | | 4/2004 | |
| DE | 103 00 371 | B3 | | 4/2004 | |
| DE | 10 2004 026 762 | A1 | | 2/2006 | |
| DE | 102004026762 | A1 | * | 2/2006 | ..... B21D 37/16 |
| DE | 10 2005 032 113 | B3 | | 2/2007 | |
| DE | 10 2005 055 494 | B3 | | 5/2007 | |
| DE | 10 2006 019 395 | A1 | | 10/2007 | |
| DE | 10 2009 018 798 | A1 | | 10/2009 | |
| DE | 102009018798 | A1 | * | 10/2009 | ..... B21D 37/16 |
| DE | 10 2008 051 471 | A1 | | 4/2010 | |
| EP | 1 426 454 | A1 | | 6/2004 | |
| FR | 2 927 828 | A1 | | 8/2009 | |
| JP | 61-272380 | A | | 12/1986 | |
| JP | 2003-154401 | A | | 5/2003 | |
| JP | 2003-328031 | A | | 11/2003 | |
| JP | 2005-342776 | A | | 12/2005 | |

* cited by examiner

METHOD AND DEVICE FOR PRODUCING A METAL COMPONENT

CROSS-REFERENCE TO RELATED PATENT APPLICATIONS

This patent application is a continuation of PCT/EP2010/061495, filed Aug. 6, 2010, which claims priority to German Application No. 102009043926.9, filed Sep. 1, 2009, the entire teachings and disclosure of which are incorporated herein by reference thereto.

FIELD OF THE INVENTION

The invention relates to a method for producing a metal structural component, in particular a vehicle structural component, in which a steel part is hot formed and is hardened at least over sections by contact with a tool surface and in which the steel part is cooled during the hardening in at least two partial regions with cooling rates differing from one another, so that the partial regions differ in their microstructure after the hardening. The invention also relates to a tool and a batch furnace for producing such a metal structural part.

BACKGROUND OF THE INVENTION

Hot-formed metal structural parts are widely used in the automotive industry, in particular in crash-relevant regions of the bodywork subjected to high transverse stresses. Thus, B pillars and B pillar reinforcements are frequently made of high-strength, hot-formed manganese-boron steel. High stretching resistances and tensile strengths in the structural component can be achieved by processing such materials in a hot forming process, so that the necessary sheet metal thickness can be considerably reduced compared to conventionally produced steel structural components and in this way a contribution to light-weight construction and thus to $CO_2$ reduction can be achieved. The disadvantage of completely hot-formed metal structural components is that the elongation at fracture of a hot-formed metal structural component is relatively low. Hot-formed metal structural components can therefore be successfully used in transverse-stressed regions, since here the high strengths, in particular the yield strength, avoid a buckling of the metal structural components. Hot-formed metal structural components cannot, however, be used in the case of longitudinally stressed metal structural components, such as for example longitudinal members, since the low elongation at fracture would not allow a uniform folding of the metal structural components and the consequence would be a failure of the material following a relatively low energy absorption.

In DE 102 56 621 B3 a sheet bar is heated under varying conditions in a straight-flow furnace, so that on account of the different material temperatures different strengths in the metal structural component are obtained after the forming. In this method the sheet bar is tempered differently when it passes through two furnace chambers, so that different structural regions are established in the hardening process. This method has the disadvantage that only two to three different zones as regards strength and elongation at fracture can be achieved in the metal structural component. These can, furthermore, be formed only in the throughflow direction of the sheet bar. The throughflow direction of a steel part or sheet bar corresponds as a rule to the largest longitudinal dimension of the steel part or sheet bar.

DE 10 2006 019 395 A1 discloses a device and a method for the forming of sheet bars of high strength and super-high strength steels, with the aim of using hot-formed metal structural components also in longitudinally-stressed regions. The method is characterised in that the forming tool for the hot forming comprises tempering means with which a steel part can be tempered in different temperature zones during the forming to different, predetermined temperature values. In this way it is possible locally to influence the microstructure in the metal structural component, so that metal structural components with location-dependent material properties can be produced. Location-dependent material properties are understood to mean that the material properties are different in at least two partial regions of the metal structural component. The different types of structure are achieved by different cooling rates of the material. The forming tools with the means for tempering are however relatively complicated to produce and are therefore expensive.

The present invention is therefore based on the technical objective of providing a method and a device for producing a metal structural component, which permits a local adjustment of the structure in the metal structural component and at the same time is inexpensive and simple to implement.

SUMMARY OF THE INVENTION

This object is achieved according to a first teaching of the present invention in a generic method, in that the cooling rates differing from one another are achieved by sections of the tool surface corresponding to the partial regions of the steel part, which differ from one another in their thermal conductivities.

It was recognised that the cooling of the steel part in the forming tool is greatly influenced by the thermal conductivity of the forming tool surface. The thermal conductivity is understood in this connection to mean in particular the thermal conductivity coefficient.

If the thermal conductivity of the adjacent surface is high, a rapid cooling of the steel part occurs, whereas if the thermal conductivity is low the steel part cools more slowly. On account of the adjustment of the cooling rate through the thermal conductivity of the tool surface the number of tempering elements, i.e. the heating or cooling elements, can be reduced, resulting in a cost saving. In addition, a non-uniform arrangement or a necessary controllability of the tempering elements can be dispensed with. This results in a cost reduction, too.

Due to the different cooling rates different types of structure are formed in the steel part and in the produced metal structural component. If the cooling rate in a partial region of the metal structural component is more than 27 K/sec, this leads to a predominantly martensitic structure with a high strength and low elongation at fracture. At a lower cooling rate a ferritic-bainitic structure with a medium strength and a medium elongation at fracture, a ferritic-pearlitic structure with a low strength and a high elongation at fracture, or a mixture of the two, are formed. Ferritic-bainitic and ferritic-pearlitic structures have a tensile strength below 860 MPa.

In a preferred embodiment of the method according to the invention the tool consists in the region of the at least two sections of the tool surface of different materials with different thermal conductivities. By a suitable choice of different materials the thermal conductivity of the tool surface can be influenced in a simple manner. In particular, adjacent sections with greatly differing thermal conductivities can be produced in this way.

The number of the sections is in general naturally not restricted to two, but can be arbitrarily large. Preferably, at least three sections are provided, so that in the metal structural component three partial regions with different types of structure and strengths are established, at least one partial region having a predominantly martensitic structure and at least two further partial regions having a predominantly ferritic-bainitic and/or ferritic-pearlitic structure.

A particularly favourable thermal conductivity with at the same time sufficient stability for use in a tool is achieved in a further preferred exemplary embodiment if the sections consist of steels, steel alloys and/or ceramics.

In a further preferred exemplary embodiment of the method according to the invention at least one of the two sections of the tool surface has a thermal conductivity-reducing or thermal conductivity-increasing surface coating. In this way the thermal conduction of the tool surface is modified by the surface coating. This allows very complex and local changes of the thermal conductivity and thus enables metal structural components with complex and locally varying microstructures to be produced. A further advantage results from the fact that a coating of a tool surface can easily be retrofitted and/or altered. Thus, metal structural components with different matched microstructures can be produced with a tool by altering the coating.

According to a second teaching of the present invention the object mentioned above can be achieved in a method for producing a metal structural component, in particular a vehicle structural component, in which a steel part is heated, in which the heated steel part is at least partially hardened by a cooling in a tool, wherein the steel part after the hardening comprises at least two partial regions with different microstructures, characterised in that the steel part is tempered before the hardening in a batch furnace comprising at least two regions, the said regions having different temperatures.

A batch furnace is understood to mean a furnace in which the steel part to be heated is not substantially moved during the heating procedure. The batch furnace is thus different to the straight-flow furnace, in which the steel part is continuously moved through the furnace during the heating.

It has been recognised that the microstructure in the metal structural component to be produced can be influenced in a simple way if the steel part is tempered locally at different temperatures before the hardening in a batch furnace. The resultant locally varying temperature differences on the surface of the hardening tool lead to different cooling rates and thus to the formation of different types of microstructures in the steel part and metal structural component. Furthermore, a ferritic-pearlitic structure can specifically be achieved by a local temperature below the austenitisation temperature and the subsequent cooling in the hardening tool.

The method has the advantage compared to the method known from the prior art that the temperatures of the steel part before the hardening can be adjusted very locally and without any directional restriction. In particular, a large number of different sections with temperatures differing from one another can be obtained with this method. Furthermore, the use of more complicated and expensive forming tools with non-uniformly arranged or controlled tempering means can be dispensed with.

In a preferred implementation of the method a method according to the first teaching of the present invention is additionally performed. Due to the combination of the first teaching with the second teaching of the invention, the effect on the microstructure of the metal structural component can be intensified, so that for example greatly different microstructures can be produced in adjacent partial regions of the metal structural component. The arrangement of the regions of the batch furnace preferably corresponds to the arrangement of the sections of the tool surface. Arrangements differing from one another are, however, conceivable.

A more efficient heating and tempering of the steel part is achieved in a preferred embodiment if the steel part is heated in a second furnace, in particular in a straight-flow furnace, before the tempering in the batch furnace. In this second furnace a homogeneous heating in particular can be carried out, preferably to a temperature in the region of or above the austenitisation temperature or $Ac_3$ temperature. In the tempering in the batch furnace the partial regions of the steel part can then be heated or cooled to the target temperatures for the subsequent hardening process. In this connection, the cooling is in particular preferably carried out in such a way that a premature hardening of the steel structural component does not take place, yet. The second furnace can in particular be in the form of a straight-flow furnace. In this way, a rapid and continuous provision of metal structural components for the batch furnace is possible.

In a further preferred embodiment of the method the steel part is hardened in a press tool. In this way, a good hardening and subsequent tempering of the steel part can be achieved. The hardening of the steel part preferably takes place immediately after the tempering in the batch furnace, in order to avoid an equalisation of the differently tempered partial regions due to the thermal conduction of the steel part.

A continuous profile of the material properties in the metal structural component is achieved in a preferred embodiment of the invention if the batch furnace comprises at least one region with a temperature gradient.

In a preferred embodiment of the method the steel part is cooled in at least one partial region of the batch furnace by adjustable gas nozzles, in particular with nitrogen.

Due to the cooling by means of the gas nozzles the regions with temperatures differing from one another are realised in a very simple manner in the batch furnace. In particular, the number of heating elements can be reduced. Furthermore, due to the controllability of the gas nozzles a flexible adjustment of the temperatures in the batch furnace is possible. Thus, different regions for different types of metal structural components can be established by the adjustment facility. The controllable gas nozzles can be used as an alternative to controllable heating elements or in combination with these. Nitrogen is used as preferred cooling gas, since it is inexpensive and inert.

The following exemplary embodiments can be used for the first teaching and also for the second teaching of the present invention.

In a preferred embodiment of the method according to the invention the steel part is directly or indirectly hot formed and/or press hardened. A high degree of flexibility in the implementation of the production process is thereby possible in this way. With an indirect hot forming the steel part is formed in at least two steps, preferably first of all by a cold forming and then by a hot forming. In a direct hot forming the forming takes place on the other hand in a single hot forming step. Indirect hot forming may be advantageous especially with high drawing depths.

A particularly flexible configuration of the metal structural component is achieved in a further embodiment if at least one boundary between the partial regions runs transversely or inclined to the largest longitudinal dimension of the steel and/or not linearly. The method accordingly permits a substantially arbitrary adjustment of the partial region boundaries relative to one another. The boundaries between the partial regions are, furthermore, preferably arranged outside joining regions of the steel part, in order to avoid damaging joint connections, in particular weld seams, due to the transition region in the region of a boundary.

In a further embodiment of the method according to the invention a semi-finished product, in particular a tailored blank, a tailored-welded blank, a patchwork blank or a tailored-rolled blank, or a sheet bar cut to size is used as steel part. The method consequently allows a maximum flexibility in the production of a metal structural component with location-dependent material properties. A tailored blank is understood to mean a sheet metal bar composed of different material qualities and/or sheet thicknesses. In a tailored-welded blank different sheet metal bars are welded to one another. A tailored-rolled blank has different sheet thicknesses produced by a flexible rolling process. A patchwork blank consists of a sheet bar to which further sheets are joined in the manner of a patchwork. Very good material properties of the metal structural component are achieved in a preferred embodiment if a steel part of manganese-boron steel, in particular MBW 1500, MBW 1700 or MBW 1900 is used, preferably in combination with a microalloyed steel, for example MHZ 340, and/or a microalloyed steel is used, for example MHZ 340.

In a further preferred embodiment of the method the steel part has an organic coating, in particular a lacquer coating, for example a scale protection coating, preferably a solvent-based or water-based, single-component, two-component or multicomponent scale protection coating. Alternatively or in addition, the steel part can have an inorganic coating, preferably an aluminium-based or aluminium-silicone-based coating, in particular a hot dip aluminised coating (fal), and/or a zinc-based coating. In this way, the surface of the metal structural component can be functionalised, so that the material properties can be matched even more flexibly.

The technical object is achieved according to a third teaching of the present invention by a use of a metal structural part, produced according to one of the aforedescribed methods, in a vehicle, in particular as an A, B or C pillar, side wall, roof frame or longitudinal member. Due to the flexible and locally adjustable material properties of the metal structural components these can be matched in an optimum manner to the stresses in a vehicle, in particular in order to improve the crash behaviour.

The technical object is achieved according to a fourth teaching of the present invention in a tool for the hot forming and hardening of steel parts, in particular for carrying out one of the previously described methods, according to the invention if the tool surface that comes into contact with the steel part comprises a plurality of sections differing in their thermal conductivities.

Due to these different sections different cooling rates are achieved in a simple manner in the hardening of a steel part and thus different types of structures can be obtained in the produced metal structural component. In particular, the number of tempering elements, for example the number of heating elements in the tool, can be reduced.

The difference in the thermal conductivity can be achieved in a preferred embodiment of the tool if the sections consist of different materials, in particular steels, steel alloys and/or ceramics, having different thermal conductivities.

In a further preferred embodiment the tool surface that comes into contact with the steel part is arranged at least partly on different replaceable segments and/or tool inserts of the tool. In this way, it is possible to arrange and rearrange the replaceable segments or tool inserts flexibly in the tool, so that metal structural components with different structure arrangements and consequently with different properties can be produced with a tool.

A simple realisation of the different thermal conductivities is achieved in a further embodiment of the tool if at least one of the sections has a surface coating that reduces or increases the thermal conductivity. Very local changes in thermal conductivity can in particular be achieved in this way. In addition, the surface coating can be removed and reapplied as necessary.

The technical object is, furthermore, achieved according to a fifth teaching of the present invention in a batch furnace for heating a steel part for a hot forming method and/or press hardening method, in particular for carrying out one of the methods described hereinbefore, if in accordance with the invention the batch furnace has at least two regions in which temperatures different from one another can be established.

In this way, a steel part can be tempered to different temperatures, so that in a subsequent hardening process different types of structures can be produced in the resultant metal structural component.

In a preferred embodiment at least one region of the batch furnace has controllable gas nozzles for cooling purposes. In this way, the regions with the different temperatures can be realised in a flexible and simple manner.

BRIEF DESCRIPTION OF THE DRAWINGS

Further features and advantages of the invention are disclosed in the following description of a plurality of exemplary embodiments, and with reference to the accompanying drawings, in which.

DETAILED DESCRIPTION OF THE INVENTION

Figure 1:
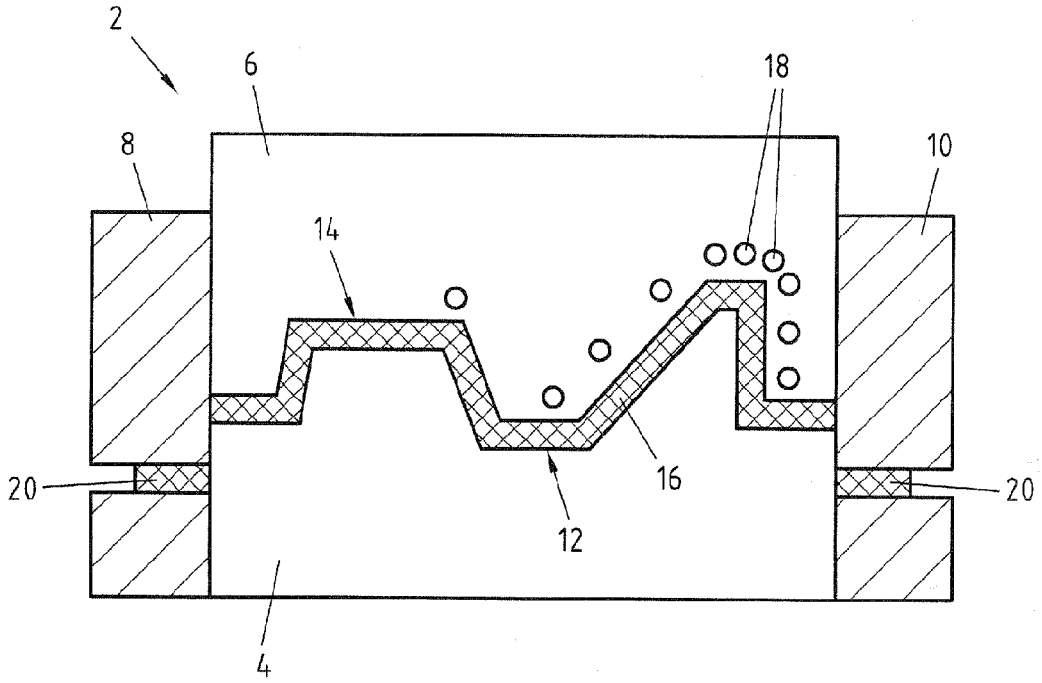
Fig.1 Prior Art
FIG. 1 shows a tool for producing a metal structural component from the prior art.

FIG. 1 shows a longitudinal section of a tool for producing a metal structural component from the prior art. The tool 2 is designed as a hot forming tool and has a lower punch 4, an upper punch 6 as well as two flange cutters 8 and 10. The surfaces 12 and 14 facing one another of the lower and upper punch 4, 6 have a profile that corresponds to the external contour of the metal structural component to be produced from a steel part 16. Tempering elements 18 are, furthermore, provided in the upper punch 6, with which the temperature in the region of the surface 14 of the upper punch 6 can be adjusted. Similar tempering elements can also be provided in the lower punch 4. The distances between the adjacent tempering elements 18 differ from one another, so that the surface 14 has a location-dependent temperature profile. In the production method of the prior art the steel part 16 in the form of a sheet bar is arranged between the separated punches 4 and 6 and the punch 6 is lowered onto the punch 4. In this way, the sheet bar is at the same time hot formed and undergoes cooling with location-dependent cooling rates. This leads to a correspondingly location-dependent structural change in the steel part. The flange regions 20 of the steel part 16 can be cut by lowering the flange cutters 8 and 10. Due to the non-uniform arrangement of the tempering elements 18 the tool 2 has a complicated structure, which in particular requires the use of a large number of tempering elements.

Figure 2:
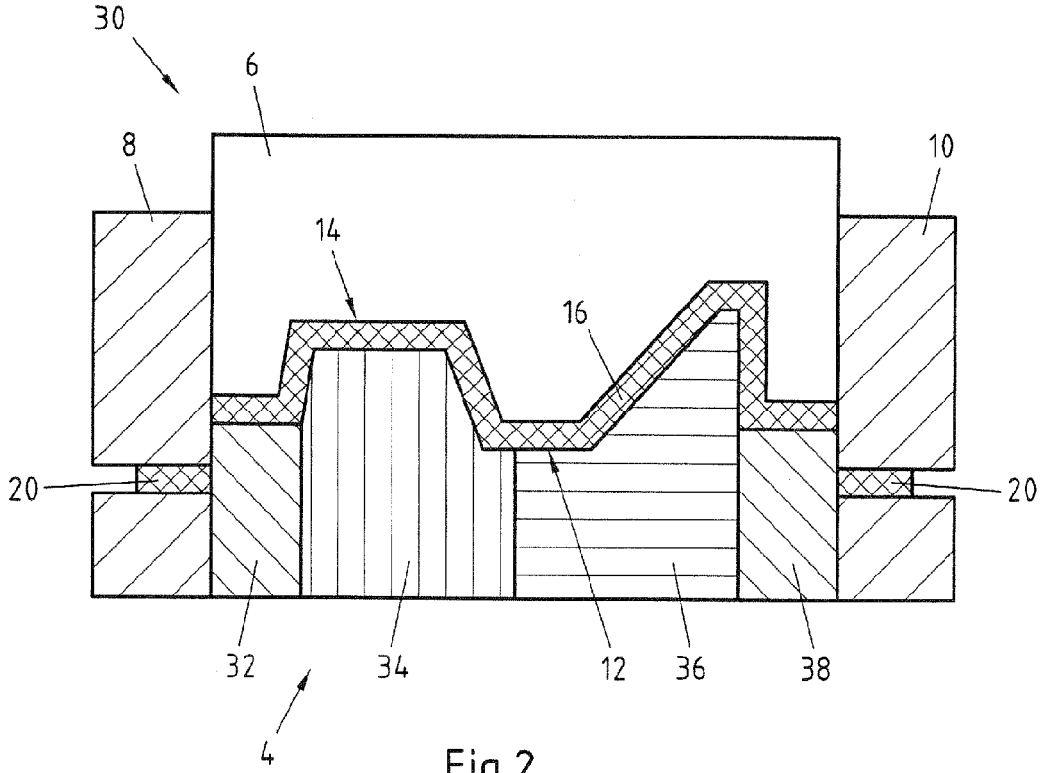
FIG. 2 shows a first exemplary embodiment of a tool and method according to the invention.

FIG. 2 now shows in longitudinal section a first exemplary embodiment of a tool and method according to the invention. Parts identical to the corresponding parts illustrated in FIG. 1 and in the following figures are provided with the same reference numerals. The tool 30 differs from the tool 2 illustrated in FIG. 1 in that the lower punch 4 has different sections 32, 34, 36, 38 that comprises different materials with different thermal conductivities. Steels, steel alloys and/or ceramics are preferably used as materials. Alternatively or in addition, also the upper punch 6 can consist of a plurality of sections of different materials. The sections can also consist of different materials simply in the region of the surfaces 12 and 14. Due to the different thermal conductivities of the individual sections 32, 34, 36, 38 different cooling rates occur in the hot forming and hardening of a steel part 16, thus, leading to the formation of different microstructures within the steel part 16.

Figure 3A:
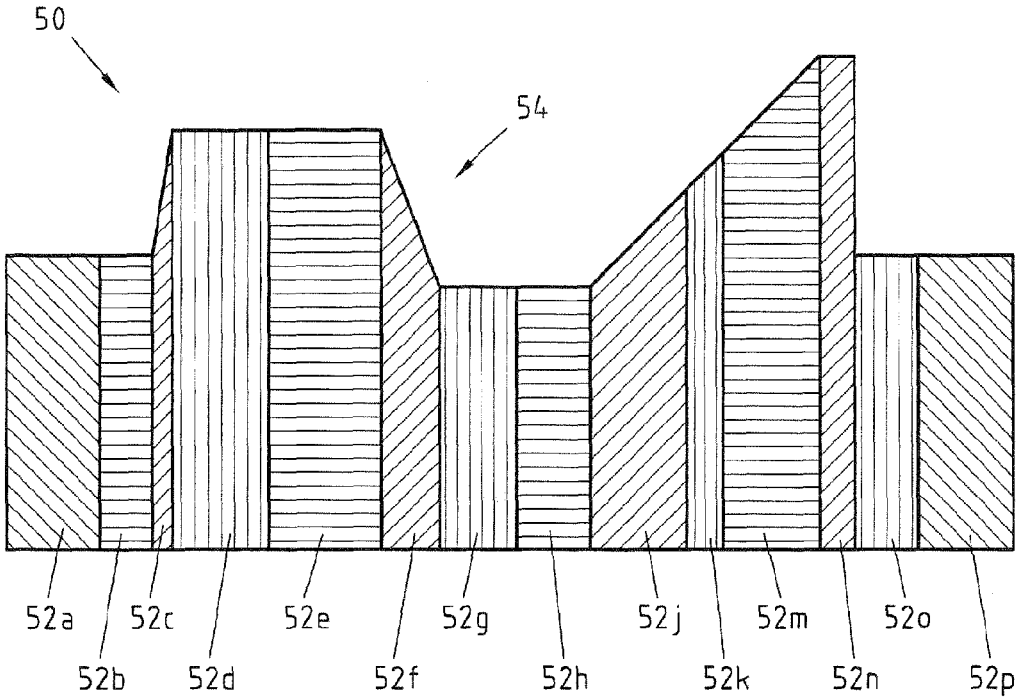
FIG. 3 shows two further exemplary embodiments of a tool and method according to the invention.
Figure 3B:
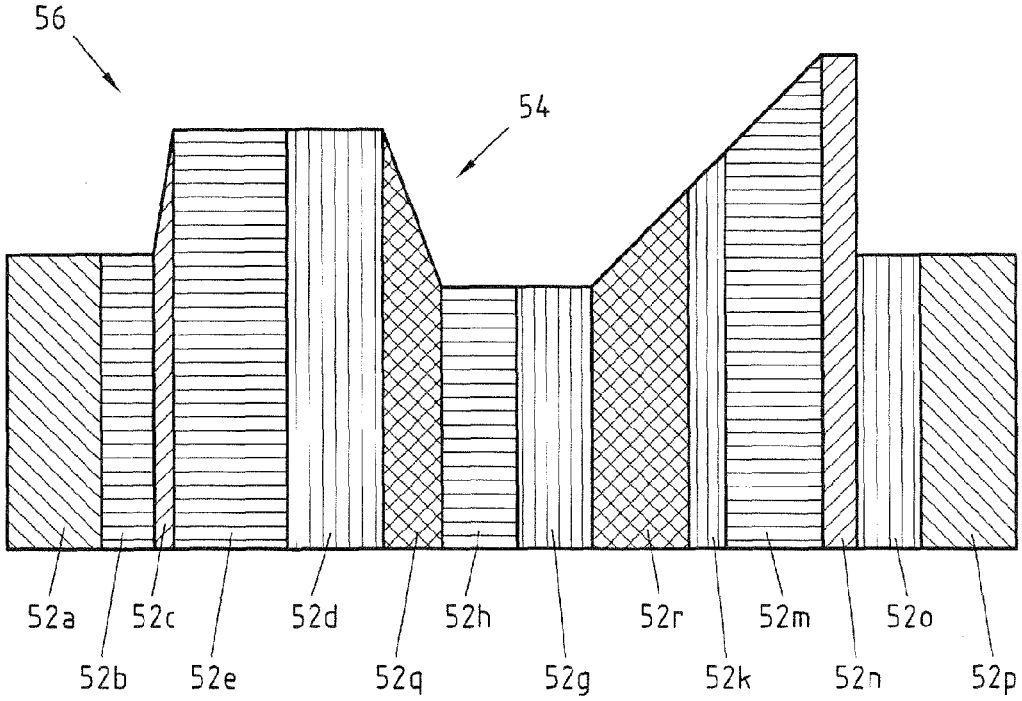

FIGS. 3*a* and 3*b* show in longitudinal section two further exemplary embodiments of a tool and method according to the invention. In the figures in each case an alternative lower punch is illustrated for a tool, for example the tool shown in FIG. 2. The lower punch 50 in FIG. 3*a* consists of a plurality of separate segments 52*a* to 52*p*, which can consist of different materials with different thermal conductivities. The overall surface 54 of the punch 50 thus has a location-dependent thermal conductivity, so that different cooling rates can be achieved in the steel part in a hot forming and hardening method using a tool containing this punch 50. Some or all segments 52*a* to 52*p* can basically be exchanged or switched over as desired. Thus, in the lower punch 56 of an exemplary embodiment of a tool according to the invention illustrated in FIG. 3*b*, the segments 52*f* and 52*j* are replaced by other segments 52*q* and 52*r* of a different material. Furthermore, the segments 52*d* and 52*e* as well as the segments 52*g* and 52*h* are switched as regards their position. Depending on the number of segments and the materials that are available, the sections of the surface 54 of the lower punches 50, 56 differing in their thermal conductivities can thus be matched in a flexible manner. Alternatively of course, also the upper punch or both punches can consist of separate segments.

Figure 4:
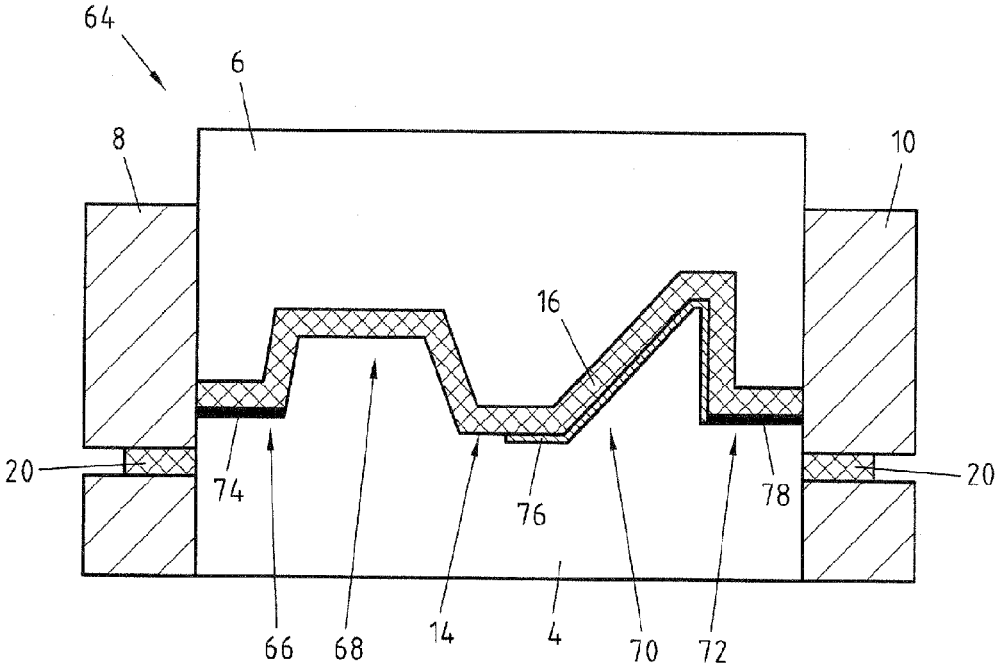
FIG. 4 shows a third exemplary embodiment of a tool and method according to the invention.

FIG. 4 shows a longitudinal section of a further exemplary embodiment of a tool according to the invention and a method according to the invention. In the tool 64 the surface 14 of the lower punch 4 has sections 66, 68, 70 and 72, of which the sections 66, 70 and 72 are coated with surface coatings 74, 76 and 78. The surface coatings 74, 76 and 78 reduce or increase the thermal conductivity of the surface 14 in the respective section. In the uncoated section 68 the thermal conductivity corresponds to that of the punch material. The surface coatings can, for example, be lacquers, in particular temperature-resistant lacquers, preferably high temperature-resistant lacquers. In the production of a metal structural component using the tool 64 the different coatings produce different cooling rates in the steel part 16, with the result that the surface structure is altered in a location-dependent manner. The surface coatings are preferably removable and can be flexibly adapted as and when necessary.

Figure 5:
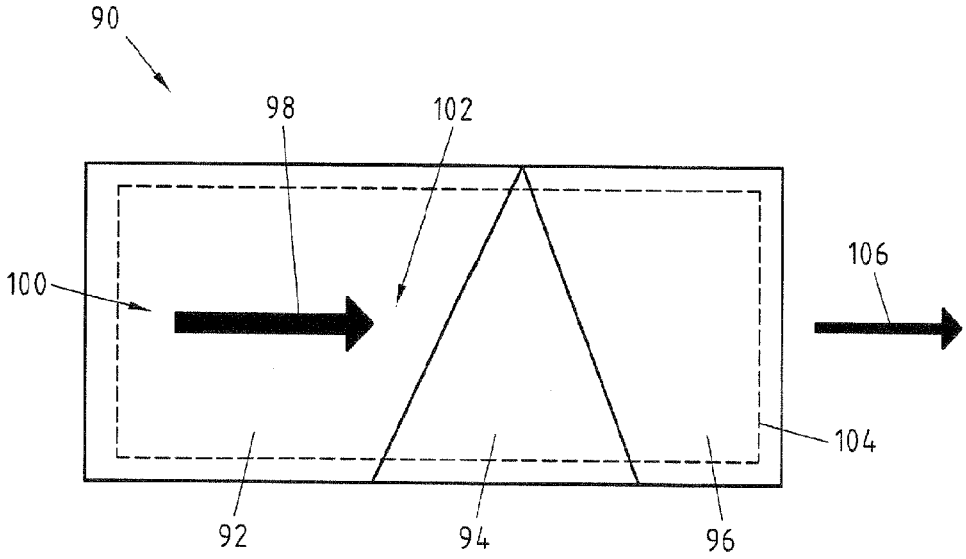
FIG. 5 shows an exemplary embodiment of a batch furnace and method according to the invention.

FIG. 5 shows an exemplary embodiment of a batch furnace according to the invention in plan view, and a further exemplary embodiment of a method according to the invention. The batch furnace 90 comprises three regions 92, 94 and 96, which differ as regards their temperatures. Thus, in the region 96 for example, the temperature can be above the austenitisation temperature, whereas the temperature in the region 94 is below the austenitisation temperature. The region 92 has a temperature gradient symbolised by an arrow 98, in other words the temperature increases from the left-hand side 100 to the right-hand side 102 of the region 92. Due to the location-dependent temperatures in the batch furnace 90 a steel part 104 formed as a sheet bar and arranged in the batch furnace 90 is locally heated or cooled to different temperatures. Following this, the sheet bar is transported in the direction of the arrow 106 from the batch furnace to a hardening tool, in particular a pressing tool. In this, the sheet bar undergoes different structural transitions in the forming and hardening on account of the local different temperatures, so that a metal structural component with a location-dependent microstructure and, thus, location-dependent properties is produced.

Figure 6:
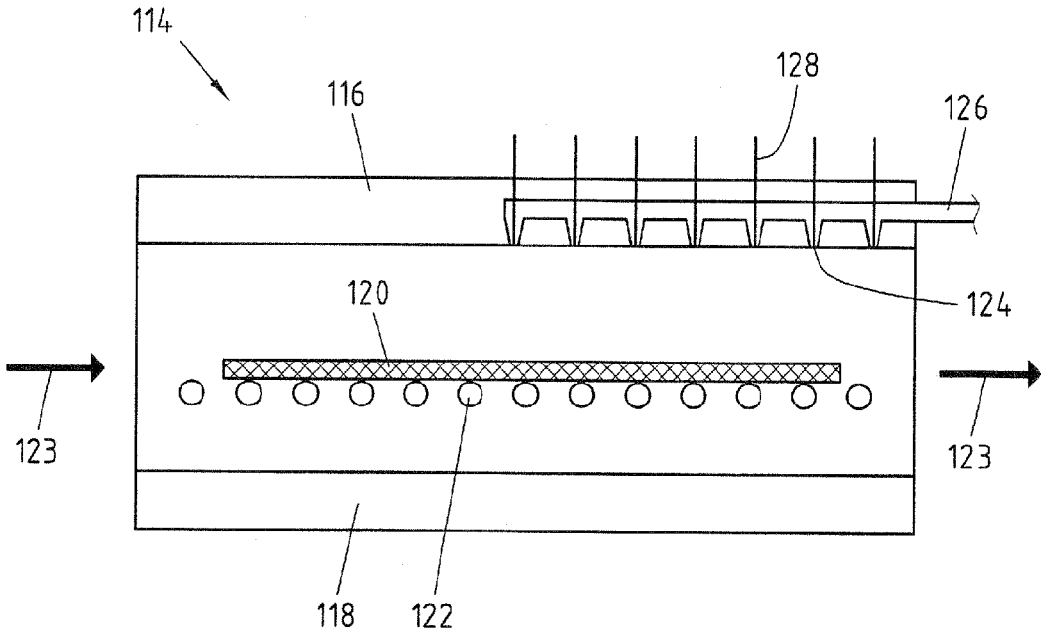
FIG. 6 shows a further exemplary embodiment of a batch furnace and method according to the invention.

FIG. 6 shows a longitudinal section of a further exemplary embodiment of a batch furnace according to the invention and a method according to the invention. The batch furnace 114 comprises heating elements 116 and 118, with which the sheet bar 120 arranged in the batch furnace 114 is heated. The sheet bar 120 lies on rollers 122, with which in the direction of the arrow 123 it can be fed to and removed from the batch furnace 114. Gas nozzles 124 are provided in the heating element 116, which are supplied with gas, in particular nitrogen, through a line 126. The gas nozzles 124 also comprise control means 128, with which the amount of gas flowing through the gas nozzles 124 can be adjusted. In this way, it is possible to cool the sheet bar in the region of a gas nozzle, so that an effectively lower temperature is established in this region of the batch furnace 114. The gas nozzles 124 can preferably be controlled individually or in groups, so that the temperature profile of the regions and/or the arrangement of the regions with different temperatures can be flexibly chosen.

Figure 7:
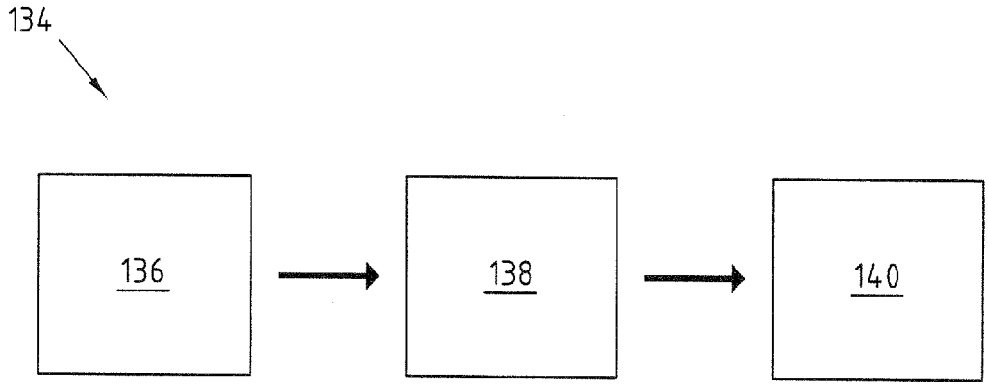
FIG. 7 shows a further exemplary embodiment of a method according to the invention.

FIG. 7 shows a further exemplary embodiment of the method according to the invention in the form of a flow diagram. In the method 134 a steel part is heated in a first step 136 in a furnace to a temperature in the region of the austenitisation temperature. In a second step 138, the steel part is then tempered in a batch furnace according to the invention, so that the steel part has partial regions with different temperatures. In a third step 140, which preferably follows directly after the second step 136, the steel part is hot formed and/or press hardened in a tool. The tool for the hot forming and/or press hardening can preferably also be designed as a tool according to the fourth teaching of the present invention. The first step 136 is optional and can also be omitted.

Figure 8:
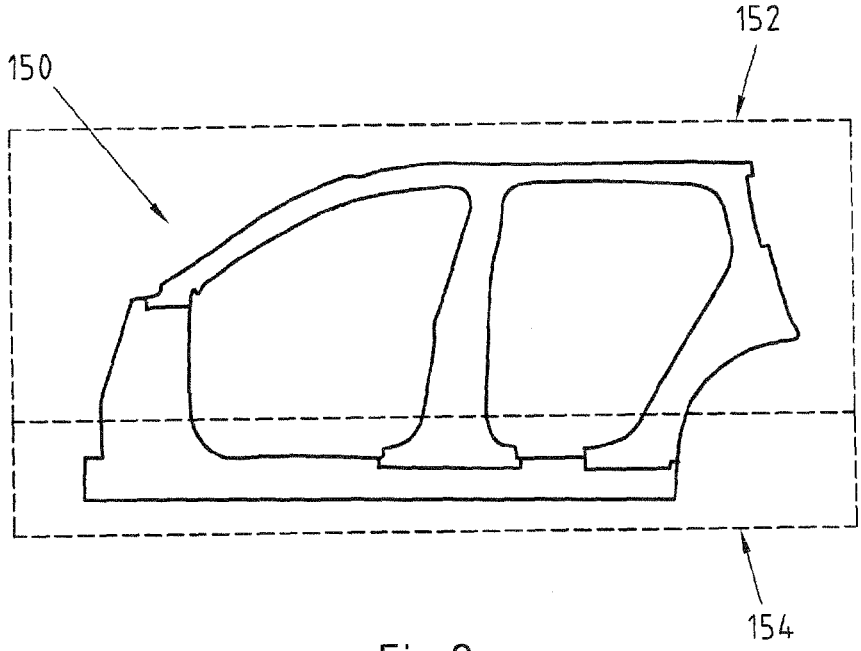
FIG. 8 shows a first metal structural component produced by a method according to the invention.

FIG. 8 shows a metal structural component 150 in the form of an one-part side wall of a vehicle, produced with a method according to the invention. The metal structural component 150 comprises two partial regions 152 and 154, which pass through different temperature progressions in the hardening of the metal structural component 150. The partial region 152 was cooled at a high cooling rate from a temperature above the austenitisation temperature. It accordingly has a predominantly martensitic structure and therefore a high strength. The partial region 154 was cooled at a lower cooling rate and/or from a temperature below the austenitisation temperature. It accordingly has a ferritic-bainitic or ferritic-pearlitic structure and consequently has a higher elongation at fracture.

Figure 9:
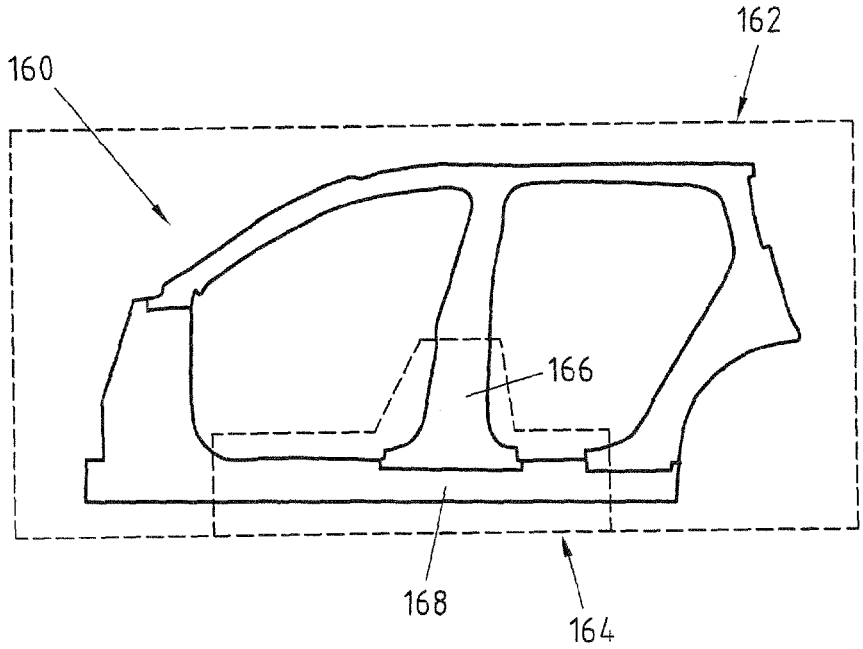
FIG. 9 shows a second metal structural component produced by a method according to the invention.

The metal structural component 160 in the form of a side wall illustrated in FIG. 9 and likewise produced by a method according to the invention has a more complex location dependence of the microstructures and is, thus, better adapted to the load stresses in the vehicle. Whereas the partial region 162 has a predominantly martensitic structure, the partial region 164, including in particular the foot of the B pillar 166, also has a ferritic-pearlitic structure and, thus, a higher elongation at fracture. This is necessary in the case of the side skirt 168 on account of the structural and mechanical stresses in the lateral pole test, and is also necessary at the foot of the B pillar 166 in order to be able to withstand the high deformations occurring in an IIHS crash. The illustrated B pillar 166 is produced from a tailored blank formed from two sheet bars of a manganese-boron steel and a microalloyed steel cut to shape and butt-joined. Compared to the side wall illustrated in FIG. 8, the side wall shown in FIG. 9 is on account of the more complex partial region arrangement and the corresponding more complex location-dependent material properties better adapted overall to the stresses occurring in a vehicle. Such metal structural components can be produced conveniently and simply with the method according to the invention and the tool and batch furnace according to the invention.

Figure 10:
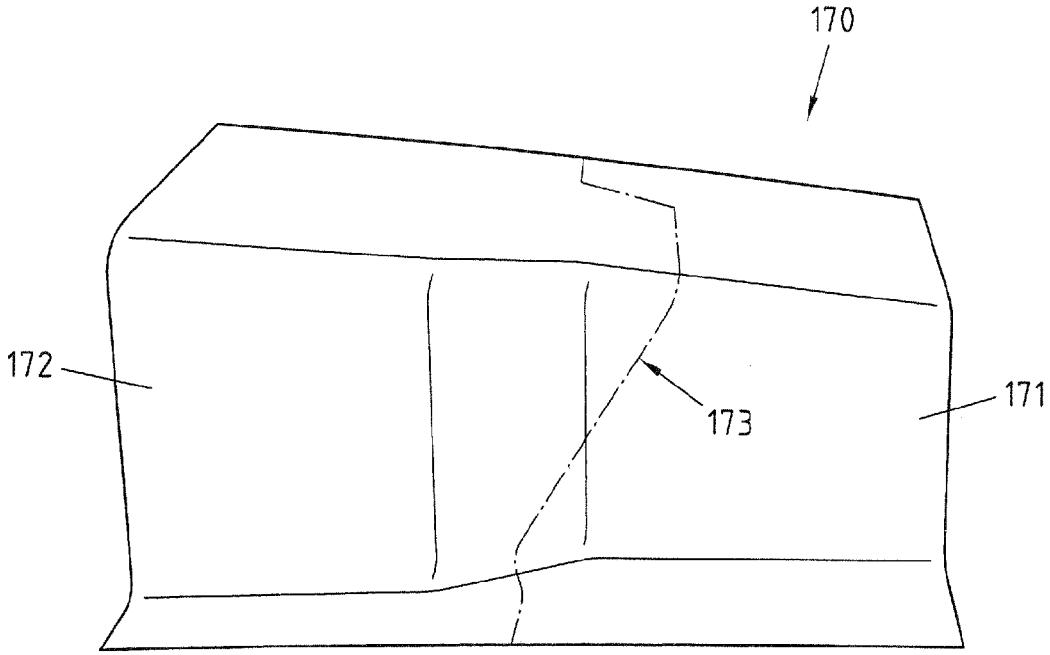
FIG. 10 shows a third metal structural component produced by a method according to the invention.

FIG. 10 shows a third metal structural component 170 produced by a method according to the invention. The metal structural component 170 has a non-linear boundary 173, which separates a first region 172 of high strength from a second region 171 of low strength and high ductility. Non-linear boundaries between two regions in the context of the present invention can be boundary profiles that run only partly rectilinearly or at least partly curvilinearly, thus, in a manner specific to the application. The metal structural component 170 illustrates the fact that the regions with different material properties, for example different strengths, and/or the transitions between the regions can be individually adjusted with the method according to the invention. The method according to the invention permits an ideal, demand-oriented matching of the different microstructures in the metal structural components to be produced, in particular for automobile construction.

The invention claimed is:

1. A method for producing a metal structural component, for use as a vehicle structural component, comprising the steps of:

forming a steel part;

hardening the steel part at least over sections by contact with a tool surface; and wherein the step of hardening includes the step of cooling the steel part in at least two partial regions with cooling rates differing from one another, so that the at least two partial regions differ after the step of hardening as regards their microstructure and wherein the cooling rates differing from one another are produced by at least two sections of the tool surface, corresponding to the at least two partial regions of the steel part, that differ from one another in their thermal conductivities, wherein at least one of the at least two sections of the tool surface has been coated so as to provide a surface coating that reduces or increases the thermal conductivity.

2. The method according to claim 1, wherein the tool in the region of the at least two sections of the tool surface consists of different materials with different thermal conductivities.

3. The method according to claim 1, wherein the at least two sections consist of steels and/or ceramics.

4. The method according to claim 1, wherein the steel part is heated in a second furnace before tempering the steel part in a batch furnace.

5. The method according to claim 1 wherein the steel part is hardened in a pressing tool.

6. The method according to claim 4, wherein the batch furnace comprises at least one region with a temperature gradient.

7. The method according to claim 1, wherein the steel part is one of directly or indirectly heat formed and/or press hardened.

8. The method according to claim 1, wherein at least one boundary between the at least two partial regions runs at least one of 1) transverse or inclined to a largest longitudinal dimension of the steel part and/or 2) runs in a non-linear manner.

9. The method according to claim 1, wherein a semi-finished product, comprising one of a tailored blank, a tailored-welded blank, a patchwork blank or a tailored-rolled blank, or a sheet bar cut to size, is used as the steel part.

10. The method according to claim 1, wherein a steel part of MBW 1500, MBW 1700 or MBW 1900, or a steel part of MBW 1500, MBW 1700 or MBW 1900 in combination with a microalloyed steel MHZ 340, or a steel part of MBW 1500, MBW 1700 or MBW 1900 in combination with a microalloyed steel MHZ 340, is used.

11. The method according to claim 1, wherein the steel part has at least one of an organic coating, comprising an anti-scale protection that is a solvent- or water-based, one-component, two-component or multicomponent anti-scale protection, and/or an inorganic coating, that is an aluminium-based or aluminium-silicone-based coating, comprising a hot dip aluminised coating and/or a zinc-based coating.

12. The method according to claim 1, further comprising:

forming at least one of an A, B or C pillar, side wall, roof frame or longitudinal member in a vehicle from said metal structural part.

* * * * *